United States Patent [19]

Tucker, Jr.

[11] 4,247,055

[45] Jan. 27, 1981

[54] PULVERIZER ROLLER LOADING

[75] Inventor: James T. Tucker, Jr., Barberton, Ohio

[73] Assignee: The Babcock and Wilcox Company, New Orleans, La.

[21] Appl. No.: 79,774

[22] Filed: Sep. 28, 1979

[51] Int. Cl.[3] ..... B02C 15/06

[52] U.S. Cl. ..... 241/119; 241/121

[58] Field of Search ..... 241/117–122, 241/132, 133

[56] References Cited

U.S. PATENT DOCUMENTS

| | | | |
|---|---|---|---|
| 3,061,208 | 10/1962 | Schauer et al. | 241/117 |
| 3,083,920 | 4/1963 | Schauer | 241/117 |
| 4,072,276 | 2/1978 | Romanowski | 241/117 |
| 4,147,308 | 4/1979 | Mikkelsen | 241/117 |

*Primary Examiner*—Mark Rosenbaum

*Attorney, Agent, or Firm*—Robert J. Edwards; John L. Lapierre

[57] ABSTRACT

An improved pulverizer roller loading arrangement applying compressive force directly to roller brackets and providing shear and pivoting means integrally connecting roller brackets to split corner roller support blocks.

13 Claims, 6 Drawing Figures

PULVERIZER ROLLER LOADING

BACKGROUND OF THE INVENTION

The invention relates to improvements in the construction and operation of pulverizers and, more particularly, to pulverizers of the roll and race configuration wherein compressive force is applied directly to the roller brackets and shear and pivoting means are provided to integrally connect the roller brackets to split corner roller support blocks.

The roll and race type pulverizer configuration is well known. In general, a roll and race type pulverizer includes a stationary housing enclosing a grinding zone, an inlet for introducing the raw coal that is to be pulverized and a horizontally disposed ring positioned in the grinding zone and having an upwardly facing annular grinding surface. A series of circumferentially equally spaced rollers are mounted above the ring which is rotated about an upright axis. Each individual roller is separately supported for rotation about its own axis. A compressive force is directed vertically through the rollers to aid in the grinding process. Air is introduced through a duct at a lower portion of the pulverizer and is utilized to transport the pulverized air-borne coal to a classifier. Coarse material is removed at the classifier and is returned via gravitational force to the grinding zone for further processing. The finer coal particles are transported through the classifier and out of the pulverizer as the finished product.

There have been prior disclosures of various configurations of pulverizers utilizing crushing or grinding rollers for grinding or pulverizing different material. Roller assemblies have been depicted connected to triangular or ring frame loading systems in an attempt to keep the rollers from planetating within the housing. Such frame systems also apply spring pressure through the roller bracket axle system to positively load the rollers against the rotating grinding table and material carried thereon.

Typical disclosures of pulverizers and roller loading systems can be found in U.S. Pat. Nos. 3,061,208 and 3,083,920 wherein a pressure transmitting ring or carrier is used to directly transmit a vertically acting compressive spring force to each pulverizer roller bracket via a pressure transmitting bearing member. In the prior art, each pressure transmitting bearing member carries an equal portion of load transmitted through the pressure frame. In the present invention the spring pressure frame is eliminated and the compressive spring force is transmitted directly to the wheel brackets and split corner roller support blocks. Means are provided to connect adjacent ends of corner blocks and brackets and the connecting means carries only a portion of the compressive spring force, the remainder being transmitted directly to the brackets. The corner blocks, which support the roller system as a unit, additionally support wear plates that contact the pulverizer housing and prevent the roller system for orbiting within the pulverizer.

SUMMARY OF THE INVENTION

The present invention relates to an improved pulverizer roller loading arrangement. Compressive spring force is applied directly to the roller brackets and shear and pivoting means are provided to integrally connect the roller brackets to split corner roller support blocks. The application of the compressive force directly to the roller brackets eliminates the need for a pressure transmitting ring or carrier that is present in the prior art as a means for force loading the pulverizer rollers and thereby lessens problems associated with pressure frame loading devices, such as noise and vibration and the need for wear plate adjustment.

The invention will be described in relation to an air-swept coal pulverizer of roll and race configuration using large diameter grinding rollers to crush coal. However, it should be understood that the invention applies to any type of air-swept pulverizer for the grinding of solid material.

The various features of novelty which characterize the invention are pointed out with particularity in the claims annexed to and forming a part of this disclosure. For a better understanding of the invention, its operating advantages and specific results obtained by its use, reference should be made to the accompanying drawings and descriptive matter in which there is illustrated and described a typical embodiment of the invention.

DESCRIPTION OF THE PREFERRED EMBODIMENT

Figure 1:
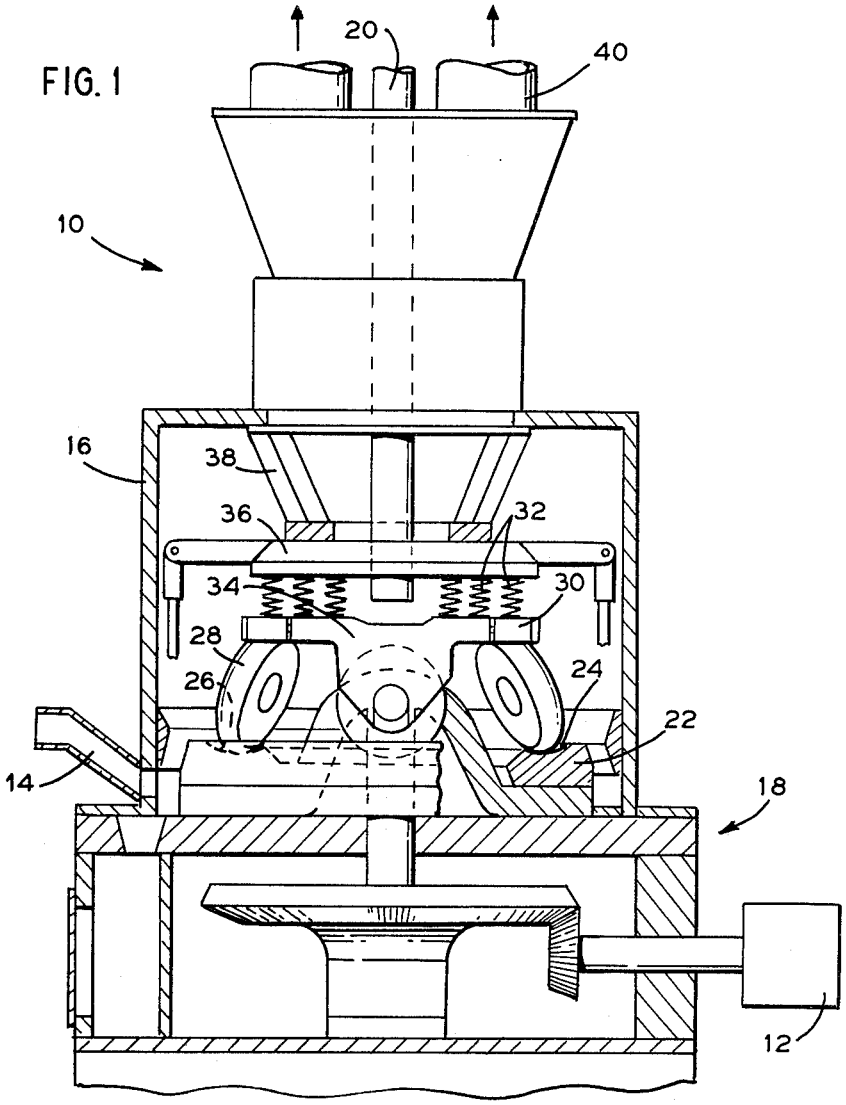
FIG. 1 is a schematic elevation view of a roll and race pulverizer.

Referring to the schematic, FIG. 1, in general, the apparatus 10 is an air-swept pulverizer of roll and race configuration that is utilized in the grinding of coal. The pulverizer includes an upper housing section 16 and a lower housing section 18 supported on a foundation. The lower housing section 18 encloses a gear drive which is separately supported by the foundation.

The pulverizer drive mechanism 12 is connected by a series of gears and shafts to rotate the horizontally disposed grinding ring 22 about an upright central axis. Coal enters the pulverizer through inlet 20 and passes downwardly and is deposited on the grinding ring 22. The pulverizer grinding zone 24 formed by the interaction of the ring 22 and roller 28, includes the horizontally disposed grinding ring 22 having an upwardly facing grinding surface or race 26 formed in its upper face. Large diameter rollers 28 are circumferentially spaced about and disposed on the grinding ring 22. A downwardly acting compressive force is applied to roller brackets 34 and split corner roller support blocks 30 by springs 32 connected to a spring loading device 36. Each roller 28 is rotatably mounted on a bracket 34 and corner roller support blocks 30 are interposed between adjacent brackets 34. The compressive force acting on the roller brackets 34 and corner support blocks 30 aids in the proper grinding action on the coal. The rollers 28 are rotated in place by the interaction of the roller surfaces and the rotation of ring 22. This interaction of the ring 22 and the surface of rollers 28 pulverizes the coal delivered to the pulverizer.

Air enters the pulverizer through duct 14, passes upwardly adjacent to the outer periphery of the grinding zone 24, entraining pulverized coal, and then passes through a classifier or separator 38 with the air-borne finished product leaving the pulverizer through upper outlets 40. Oversized material is passed downwardly from the classifier 38 for return to the grinding zone 24 for further processing.

Figure 2:
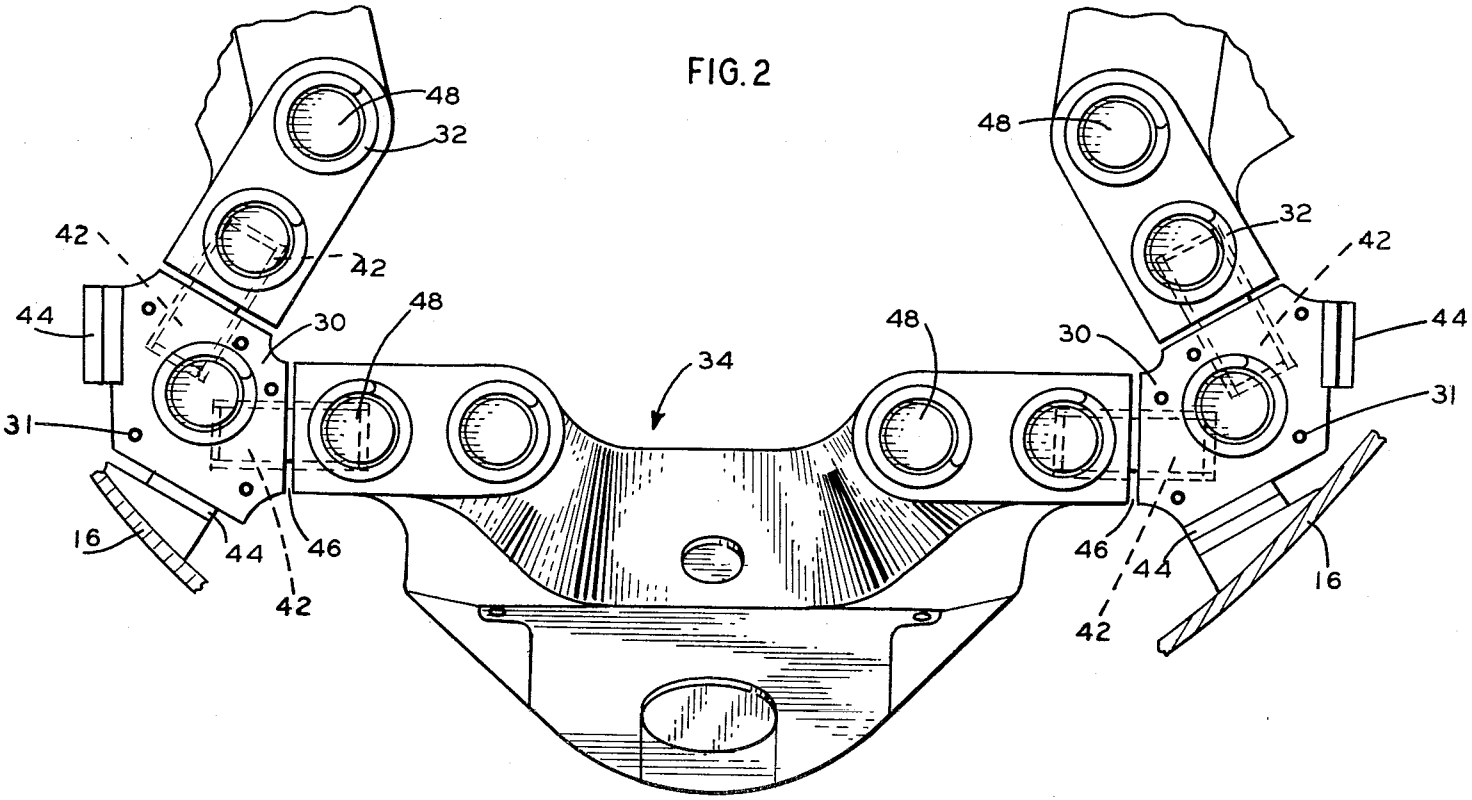
FIG. 2 is a plan view of a pulverizer roller bracket embodying one aspect of the invention.
Figure 3:
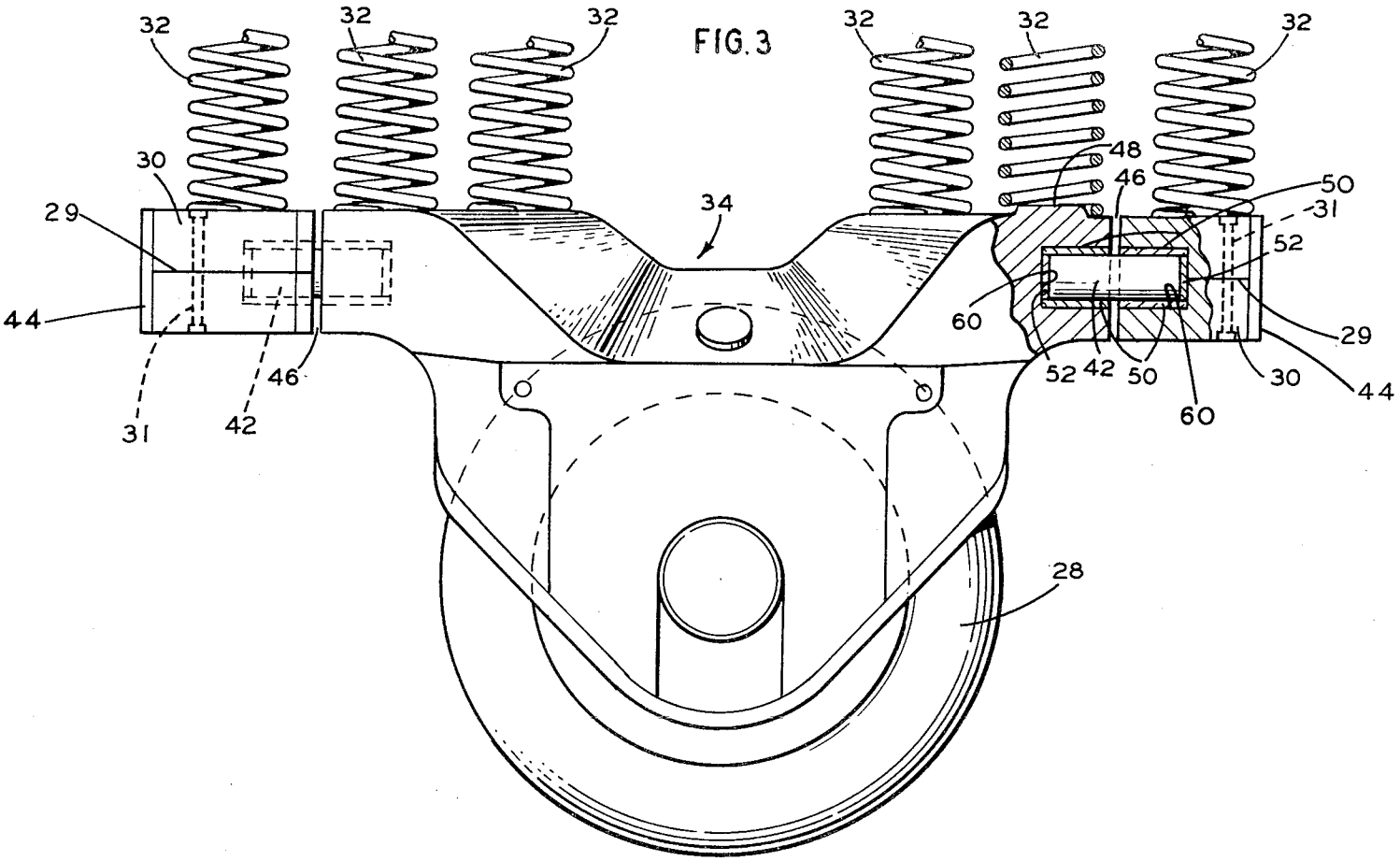
FIG. 3 is an elevation view of the roller bracket shown in FIG. 2.
Figure 4:
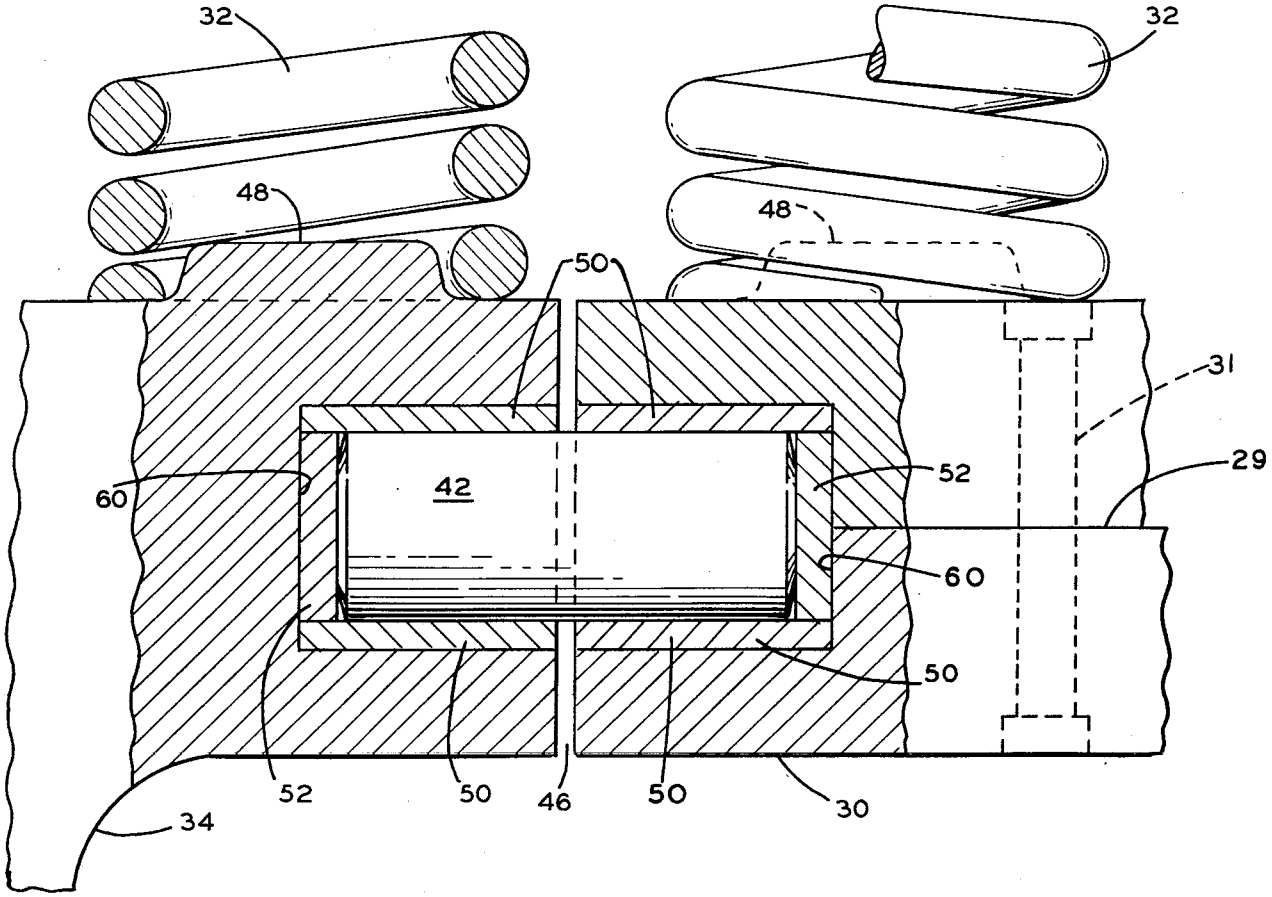
FIG. 4 is a detailed close-up view of a typical roller bracket split corner block connection shown in FIG. 3.

FIGS. 2, 3 and 4 provide a detailed description of a preferred embodiment of the invention. The force exerted by the springs 32 is directly disposed on brackets 34 and split corner support blocks 30. Cylindrical trunnions 42 are inserted into the recesses 60 formed at the ends of each bracket 34 and the ends of adjacent corner blocks 30. The trunnions 42, inserted into each end of a bracket 34 and adjacent corner blocks 30, connect the bracket 34 to the corner blocks 30 in a manner permitting axial and pivoting motion. Corner blocks 30 are split along horizontal centerline 29 and fastening bolts 31 are provided to connect upper and lower portions of the corner blocks 30. All brackets 34 and corner blocks 30 are so connected throughout the roller assembly.

Wear plates 44, supported by corner blocks 30 and pulverizer housing 16, oppose the driving torque of the rotating grinding ring 22. The vertical orientation of the wear plates 44 allows for vertical motion as wear of the grinding elements occurs.

The trunnions 42 are fitted onto replaceable hardened steel guide bushings 50 located in recesses 60. The bushings 50 face the upper and lower surfaces of the trunnions 42 and the bushings can be rotated or interchanged for increased wear life. Hardened steel disks 52 are disposed within the recesses 60 and face the ends of the trunnions 42. The stack-up of tolerances of the trunnions 42, steel disks 52 and recesses 60 can maintain or eliminate the gap 46 between the ends of brackets 34 and corner blocks 30 so that frictional damping of the radial swing of the brackets 34 can be minimized or maximized to control vibration. Load springs 32 rest directly on the brackets 34 at cast bosses 48 and utilize axial bending deflection of the springs 32 to accommodate the radial angular motion of the brackets 34.

The trunnions 42 are not the major load transmission means between the springs 32 and the brackets 34 but only carry a small percentage of the spring load to the brackets. The trunnions 42 transmit the static and dynamic forces from the brackets 34 to the corner blocks 30 mainly by transverse shear with some low bending stress superimposed. The driving forces are transmitted by the trunnions 42 mainly by axial compression.

The driving force from the grinding ring 22 causes each roller bracket 34 to close the axial clearances in a direction that loads its wear plate. This action causes the roller bracket assembly to expand, compensating continuously for wear on the wear plates 44, and causes the wear plates 44 to remain in contact and distribute the driving forces equally to the pulverizer housing 16, producing continuous frictional damping with low impact forces resulting in reduced vibration and noise.

Figure 5:
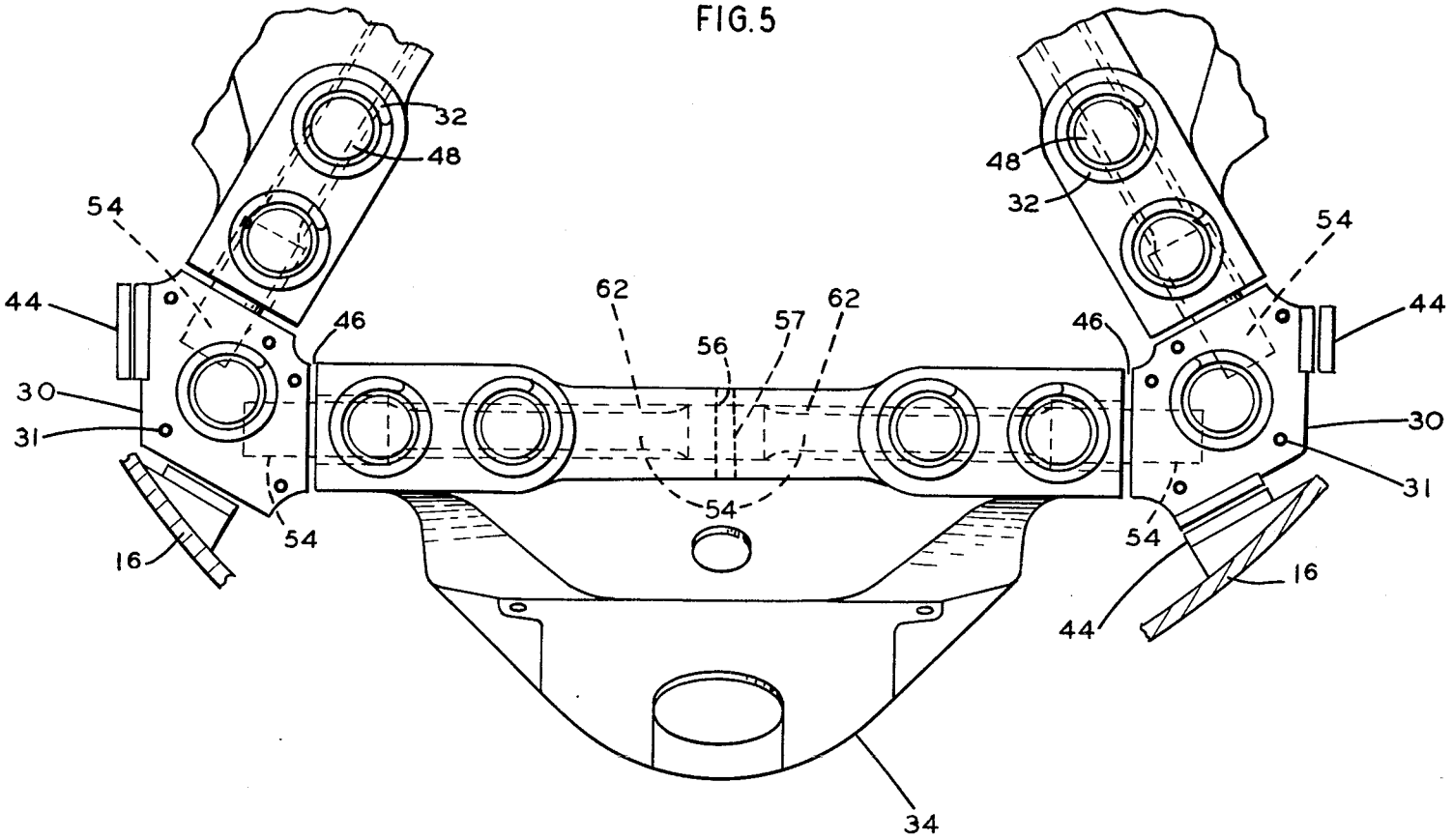
FIG. 5 is a plan view of a pulverizer roller bracket embodying another aspect of the invention.
Figure 6:
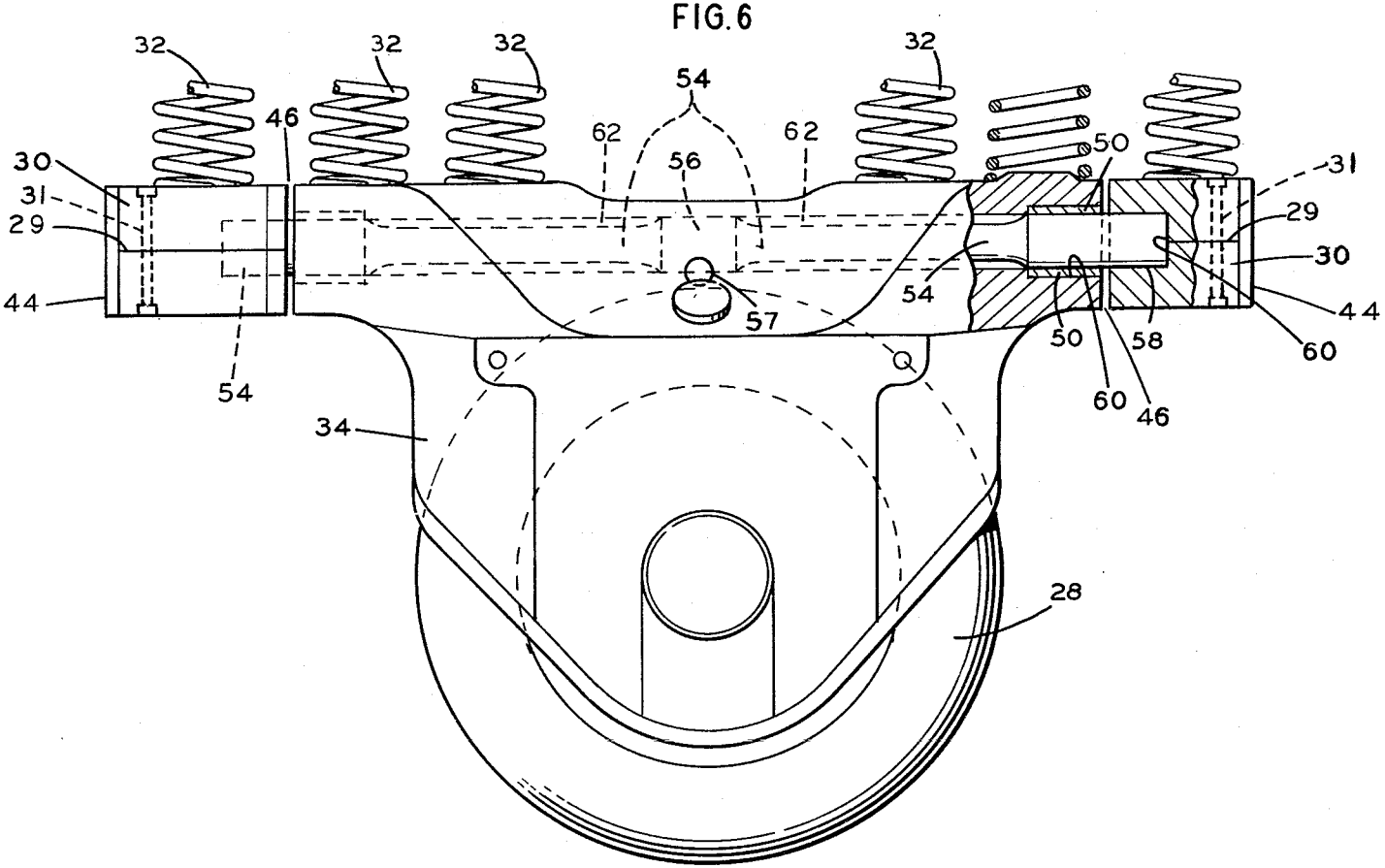
FIG. 6 is an elevation view of the roller bracket shown in FIG. 5.

FIGS. 5 and 6 provide a detailed description of another embodiment of the invention. Adjacent ends of brackets 34 and corner blocks 30 are formed with recesses 60. Each bracket 34 has a recess 60 at each end and the recesses are interconnected by a passageway 62.

Each bracket 34 has a torsion bar 54 that extends through passageway 62 and is fitted into the recesses 60 of adjacent corner blocks 30 and pivotally anchored therein at 58 by providing torsion bar end shapes and corresponding corner block recesses of different configuration than that of the circular internal shape of the bar. The ends of the torsion bars and corner block recesses could take the shape of a polygon to provide rotational resistance while allowing axial motion. The torsion bars 54 provide the connecting means between the bracket ends and adjacent corner blocks 30. The torsion bars 54 are also anchored pivotally within the bracket passageway 62 near the center 56 of bracket 34 and could be so anchored in a manner similar to the anchoring at the corner blocks. Additionally, the torsion bar 54 is keyed at 57 to prevent axial movement. Hardened steel guide bushings 50 are disposed within brackets 34 at recesses 60 at opposite ends of the brackets and envelope the portion of the torsion bars located within the bracket recesses. Alternatively, guide bushings 50 could be omitted and thereby permit automatic toe-in or toe-out of the roller 28 to minimize grinding forces.

The torsion bars 54 fix the angular position of the brackets 34 with respect to the overall roller assembly, and, if the operation of the pulverizer 10 causes an angular shift of a bracket 34, the torsion bar 54 associated with that bracket is twisted and sets up a restoring force causing the bracket 34 to return to its initial position after the shifting force has been removed. This feature allows optimum location of the roller 28 and permits angular motion of the roller when required.

The embodiments of the invention in which an exclusive property or privilege is claimed are defined as follows:

1. A pulverizer including a housing with wear plates, a horizontally disposed ring positioned within the housing and having an upwardly facing grinding surface, means for rotating the ring about an upright axis, a plurality of rollers circumferentially spaced about and disposed on the grinding surface, means for exerting downward pressure on the rollers, each roller being rotatably mounted on a bracket, corner blocks with wear plates cooperating with the housing wear plates are interposed between adjacent brackets, and means for connecting the adjacent ends of the corner blocks and brackets whereby the last named means is subjected to only a fraction of the pressure being exerted on said rollers.

2. A pulverizer according to claim 1 including the pressure exerting means being directly disposed on said brackets and corner blocks.

3. A pulverizer according to claim 1 wherein the connecting means provide self adjustment resulting in constant pressure between the wear plates.

4. A pulverizer according to claim 1 wherein the adjacent ends of the brackets and corner blocks are formed with recesses, and the connecting means having at least portions thereof disposed within said recesses.

5. A pulverizer according to claim 4 wherein the connecting means are trunnions.

6. A pulverizer according to claim 5 including hardened steel guide bushings disposed within the recesses and facing upper and lower surface portions of said trunnions.

7. A pulverizer according to claim 6 including hardened steel disks disposed within the recesses and facing the ends of said trunnions.

8. A pulverizer according to claim 1 wherein the connecting means are torsion bars.

9. A pulverizer according to claim 8 wherein the adjacent ends of the brackets and corner blocks are formed with recesses, and including the recesses of each bracket defining a passageway interconnecting the ends of said bracket.

10. A pulverizer according to claim 9 wherein each bracket includes a torsion bar extending through said passageway.

11. A pulverizer according to claim 10 wherein the torsion bar is anchored within said passageway

12. A pulverizer according to claim 9 wherein the ends of the torsion bar are anchored within the recesses of the corner blocks disposed adjacent the ends of the bracket associated with the torsion bar.

13. A pulverizer according to claim 9 including hardened steel guide bushings disposed within the bracket recesses and enveloping said torsion bar.

* * * * *